US006457519B1

(12) United States Patent
Buytaert

(10) Patent No.: US 6,457,519 B1
(45) Date of Patent: Oct. 1, 2002

(54) EXPANDABLE CENTRALIZER

(75) Inventor: Jean P. Buytaert, Houston, TX (US)

(73) Assignee: Antelope Oil Tool and Manufacturing Company, Inc., Mineral Wells, TX (US)

( * ) Notice: Subject to any disclaimer, the term of this patent is extended or adjusted under 35 U.S.C. 154(b) by 31 days.

(21) Appl. No.: 09/789,243

(22) Filed: Feb. 20, 2001

(51) Int. Cl.[7] ..... E21B 17/10

(52) U.S. Cl. ..... 166/241.6; 166/241.3; 166/241.4; 166/241.7; 166/172; 175/325.7

(58) Field of Search ..... 166/206, 241.2, 166/241.3, 241.4, 241.6, 241.7, 172; 175/325.5, 325.6, 325.7

(56) References Cited

U.S. PATENT DOCUMENTS

| | | | | | |
|---|---|---|---|---|---|
| 1,565,518 | A | * | 12/1925 | Smyser | 137/68.11 |
| 2,898,136 | A | * | 8/1959 | Hall, Sr. et al. | 166/241.7 |
| 3,065,005 | A | * | 11/1962 | Hall, Sr. et al. | 166/241.6 |
| 3,200,884 | A | * | 8/1965 | Solum et al. | 166/241.6 |
| 3,556,042 | A | * | 1/1971 | Laughlin | 166/241.7 |
| 3,566,965 | A | * | 3/1971 | Solum | 166/241.7 |
| 3,575,239 | A | * | 4/1971 | Solum | 166/241.7 |
| 3,578,084 | A | * | 5/1971 | Bombardieri et al. | 166/241.6 |
| 3,749,168 | A | * | 7/1973 | Hall, Sr. | 166/241.7 |
| 4,011,907 | A | * | 3/1977 | Clay | 166/241.7 |
| 4,021,083 | A | * | 5/1977 | Anderson | 175/325.6 |
| 4,042,022 | A | * | 8/1977 | Wills et al. | 166/241.7 |
| 4,077,470 | A | * | 3/1978 | Dane | 166/241.7 |
| 4,088,186 | A | * | 5/1978 | Callihan et al. | 166/173 |
| 4,219,081 | A | * | 8/1980 | Howe | 166/241.7 |
| 4,269,269 | A | * | 5/1981 | Wilson | 166/241.7 |
| 4,363,360 | A | * | 12/1982 | Richey | 166/241.7 |
| 4,456,064 | A | * | 6/1984 | Ford | 166/173 |
| 4,520,869 | A | * | 6/1985 | Svenson | 166/172 |
| 4,531,582 | A | * | 7/1985 | Muse et al. | 166/172 |
| 4,545,436 | A | * | 10/1985 | Harrison | 166/241.7 |
| 4,603,737 | A | * | 8/1986 | Spikes | 166/241.7 |
| 4,651,823 | A | * | 3/1987 | Spikes | 166/241.7 |
| 4,688,636 | A | * | 8/1987 | Hennessey | 166/241.7 |
| 4,794,986 | A | * | 1/1989 | Langer | 166/241.7 |
| 4,875,524 | A | * | 10/1989 | Bradley et al. | 166/241.6 |
| 4,909,322 | A | * | 3/1990 | Patterson et al. | 166/241.7 |
| H1192 | H | * | 6/1993 | Keller | 166/241.6 |
| 5,238,062 | A | * | 8/1993 | Reinholdt | 166/241.7 |
| 5,575,333 | A | | 11/1996 | Lirette et al. | 166/241.1 |
| 6,039,131 | A | | 3/2000 | Beaton | 175/376 |
| 6,367,556 | B1 | * | 4/2000 | Moore | 166/241.1 |
| 6,102,118 | A | * | 8/2000 | Moore | 166/241.7 |

FOREIGN PATENT DOCUMENTS

GB 2201176 A * 8/1988 ..... E21B/17/10

OTHER PUBLICATIONS

"Davis Cementing Enhancement Devices", Mar. 1990 (date device patented) pp. 14–17.*

Titan, "Lower Bor Spring Centralizer", Dec. 1, 2000, two pages.*

Top–Co Industries Ltd., "Top–Co Centralizers", date unknown, pp. 1–9.*

Baker Oil Tools, "Thru–Tubing Accessory Tools", date unknown , 10 pages.*

(List continued on next page.)

*Primary Examiner*—David Bagnell
*Assistant Examiner*—Jennifer H Gay
(74) *Attorney, Agent, or Firm*—Rosenthal & Osha L.L.P.

(57) ABSTRACT

A centralizer for laterally positioning an instrument in an opening larger in diameter than the diameter of an opening through which the centralizer can freely pass. The centralizer includes spring blades affixed at one end to an outer surface of the instrument and extending axially to a stop collar rotatably positioned on the outer surface of the instrument. A latch is operatively coupled to the stop collar and is adapted to enable rotation of the stop collar about the instrument upon release of the latch.

16 Claims, 4 Drawing Sheets

OTHER PUBLICATIONS

Frank's International, brochure for Antelope Oil Tool & Manufacturing Company, Inc., undated, 4 pages.
"Specification for Bow–Spring Casing Centralizers", API Specification 10D Fifth Edition, American Petroleum Institute, Washington, D.C., Jan. 1, 1995, 21 pages.
Antelope Oil Tool & Manufacturing Company, Inc. Cementation Training Manual, 26 pages.
Turbeco brochure,CPACS "Pressure Actuated Integral Joint Bow Spring Centralizer", Copyright 2000 Flotek Industries, Inc.; CPACS 10/00 version 1.

* cited by examiner

EXPANDABLE CENTRALIZER

FIELD OF THE INVENTION

The invention is related generally to the field of centralizers, such as used on casing inserted in wellbores drilled through the earth. More specifically, the invention is related to centralizers which can pass through an opening that is smaller than the opening in which a device is to be centralized.

BACKGROUND OF THE INVENTION

Wellbores drilled through the earth to extract petroleum and the like are commonly "completed" by cementing a steel pipe or casing in the wellbore after it is drilled. The casing serves to maintain the mechanical integrity of the wellbore, provides a conduit for produced fluids to move to the earth's surface, and hydraulically isolates earth formations from each other so that high fluid pressure earth formations do not discharge fluid into lower fluid pressure earth formations.

The casing is typically inserted into the drilled wellbore by coupling segments of the casing together and lowering the coupled segments into the wellbore. To cement the casing in place in the wellbore, cement is typically pumped through the interior of the casing, and is discharged into an annular space between the casing and the wellbore from the bottom of the casing. An important aspect of properly cementing the casing in place to complete a wellbore is that the casing have a substantially uniform annular space around it at all places along the length of the wellbore. Uniformity of the annular space increases the likelihood that the cement will completely and uniformly fill the annular space, thereby ensuring that the wellbore properly hydraulically isolates earth formations from each other. Uniformity of the annular space is affected by the trajectory of the wellbore and the final shape of the wellbore, among other factors. Frequently wellbores are drilled along trajectories other than vertical, so earth's gravity and bends in the wellbore cause the casing to rest on the wall of the wellbore in some places along the wellbore. In other cases, the wall of the wellbore may include out of round sections, for example washouts or keyseats, which make cementing operations more difficult.

It is known in the art to use centralizers to keep the casing as close as possible to the center of the wellbore for proper cementing. Typical centralizers known in the art are shown, for example, in a sales brochure published by Antelope Oil Tool & Manufacturing Company, Mineral Wells, Tex. (not dated). Centralizers are typically coupled to the exterior surface of the casing at selected locations along the casing prior to inserting the casing into the wellbore. Blades on the centralizers provide a restoring force which tends to push the casing into the center of the wellbore. Specifications for the amount of restoring force, and proper use of centralizers are described in a document entitled, *Specifications for Bow-Spring Centralizers, API Specification* 10*D*, fifth edition, American Petroleum Institute, Washington, D.C. (1994). Generally speaking, casing centralizers are made to center a particular outside diameter (OD) casing within a particular nominal diameter wellbore. The casing OD is selected by the wellbore operator to closely match the wellbore diameter, which primarily related to the diameter of the drill bit used to drill that segment of the wellbore.

More recently, it has become known in the art to drill wellbores to a depth greater than a depth to which casing has been set, in which the greater depth portion of the wellbore has a diameter larger than the diameter of the casing. This type of drilling can be performed using various types of reaming tools such as hydraulic underreamers or specialized drill bits known as bi-center bits. See, for example, U.S. Pat. No. 6,036,131 issued to Beaton. Drilling this type of wellbore makes it possible to insert a larger completion device in the deeper portion of the wellbore, such as gravel pack or sand screens, than would be possible using conventional drilling techniques. Completing wellbores having such deeper sections including oversize diameters using centralizers known in the art has proven difficult because it is impracticable to move a larger outside diameter centralizer through a smaller internal diameter casing or other opening.

It is desirable to have a centralizer which can position a casing inside a larger diameter wellbore than the opening through which the centralizer can freely pass.

SUMMARY OF THE INVENTION

The invention is a centralizer for laterally positioning an instrument in an opening larger in diameter than a diameter of an opening through which the centralizer can freely pass. A plurality of spring blades extend substantially axially between a fixed position along the instrument to a rotatable stop collar at another axial position along the instrument A latch is operatively coupled to the stop collar the instrument surface, and is adapted to enable rotation of the stop collar about the instrument upon release of the latch.

In one embodiment, the latch includes a control latch pivotally coupled at one end to the outer surface of the instrument and releasably locked to the outer surface of the instrument at its other end. The latch according to this embodiment includes a responding latch pivotally operationally coupled to the outside surface of the instrument. The responding latch is operatively engaged with the control latch at one end and is operatively engaged to the stop collar at the other end. The control and responding latches have pivot positions selected so that a force applied by locking the control latch is substantially less than a force applied by the stop collar to the responding latch.

DETAILED DESCRIPTION

Figure 1:
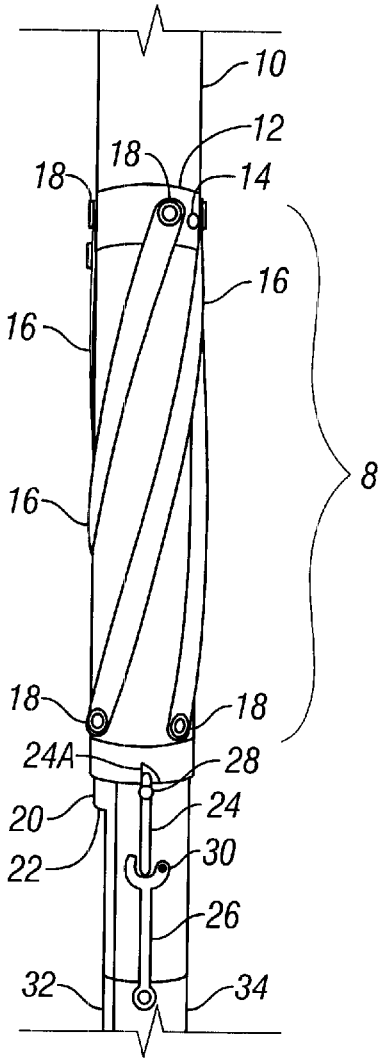
FIG. 1 shows one embodiment of a centralizer in compressed form.

One embodiment of a centralizer according to the invention is shown in FIG. 1. The embodiment shown in FIG. 1 has the centralizer in a form to pass through a smaller diameter opening than the diameter of the opening in which an instrument is to be centralized. This embodiment of the centralizer 8 includes a first stop collar 12 which is affixable to the exterior surface of a casing 10 or any other instrument to be centralized in an opening (such as a wellbore). The first stop collar 12 can be affixed using set screws 14 or the like as is conventional for affixing stop collars of conventional casing centralizers. The first stop collar 12 is generally affixed so as to be immobile about the exterior surface of the casing 10 both axially and rotationally. A plurality of spring blades 16 are each attached at one end thereof to the first stop collar 12 around the circumference thereof. The spring blades 16 are similar in type and construction to spring blades used on conventional bow-spring centralizers. In this embodiment, the spring blades 16 are coupled to the first stop collar 12 using roller bearings 18 or similar anti-friction device. It should be noted that the first stop collar 12 is used in this embodiment to make the centralizer 8 easier to affix to the outside surface of the casing 10 or other instrument. For purposes of the invention, it should be understood that it is only necessary to fix the axial and rotational (circumferential) position of the spring blades 16 at one end thereof with respect to the casing 10. Accordingly, it is within the contemplation of the invention that the ends of the spring blades 16 are affixed to the casing 10 such as by direct welding or attaching the roller bearings 18 directly to the casing 10 at the selected position.

In this embodiment, the spring blades 16 are each coupled to a second stop collar 20 at the other end thereof. The second stop collar 20 is positioned at an axially spaced apart position along the outside surface of the casing 10. The spring blades 16 may also be coupled to the second stop collar 20 using roller bearings 18 or the like, just as they may be coupled to the first stop collar 12, or they may be affixed thereto such as by welding or the like. The axial position of the second stop collar 20 in this embodiment maintained to limit the axial separation from the first stop collar 12 (or the point of attachment of the ends of the blades 16 to the casing 10) by at least one retainer pin 22. The at least one retainer pin 22 may be a roll pin, roller bearing, or any other device intended to limit the axial separation of the second stop collar 20 from the first stop collar 12, while enabling the second stop collar 20 to freely rotate about the exterior of the casing 10. As shown in FIG. 1, the second stop 20 collar is rotated with respect to the first stop collar 12 so that the spring blades 16 traverse a smaller external diameter (become laterally compressed) than if the rotational positions of each end of each of the spring blades 16 were the same about the circumference of the casing 10. In this manner, the spring blades 16 can pass through an opening considerably smaller than the opening through which they would otherwise be able to pass. At the same time, rotating the second stop collar 20 to laterally compress the spring blades 16 produces a strong torsional force on the second stop collar 20 tending to rotate it to decompress the spring blades 16 when released. In this way, potential energy is stored in the form of torsion, which can be later released to lift and/or centralize a casing or other instrument in an opening which is larger than the opening through which the centralizer 8 may freely pass.

In this embodiment, the rotational position of the second stop collar 20 is selectably fixed with a releasable latch 25. The releasable latch 25 in this embodiment includes a control latch 26 rotatably affixed to the casing 10 about pin 30, and selectively held in rotary position by a lock 32. The lock 32 may be disposed in a slot 34 made therefor in the exterior surface of the casing so as to respond to a releasing operation which will be further explained. The control latch 26 includes therein a slot as shown in FIG. 1 for receiving a responding latch 24 which is also rotatably affixed to the outside of the casing such as by pin 28. One end of the responding latch 24 is disposed in the corresponding slot in the control latch 26, and the other end of the responding latch 24 is disposed in a locking slot 24A formed in the axial edge of the second stop collar 20. Preferably, the lengths and positions of the pins 28, 30 for the responding and control latches, 24, 26, respectively, are selected so that the rotational position of the second stop collar 20 may be maintained by a much smaller restraining force on the lock 32. In this way, the lock 32 may be designed to be released using only a minimal force, while enabling a very large rotational torque to be applied to the second stop collar 20 and restrained by the latch 25.

Figure 2:
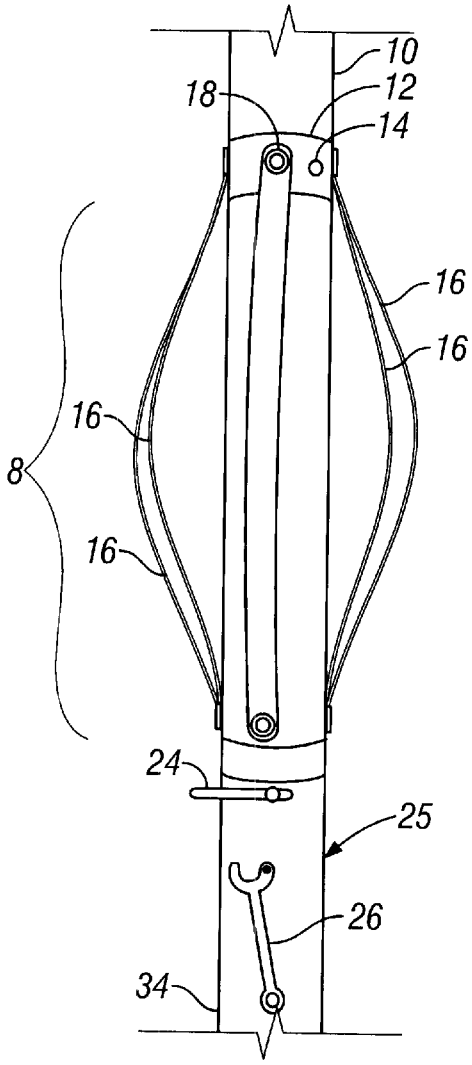
FIG. 2 shows the embodiment of FIG. 1 in expanded form.

The condition of the centralizer 8 upon release of the lock 32 is shown in FIG. 2. When the lock 32 is released, torque on the second stop collar 20 urges the responding latch 24, which itself urges the control latch 26 to rotate as shown in FIG. 2. Rotation of the responding latch 24 out of the locking slot 24A in the second stop collar 20 frees the second stop collar 20 to rotate. This enables the spring blades 16 to unwind. Recall, however, that the axial position of the second stop collar 20 is limited by the retainer pin 22. Therefore, when the spring blades 16 unwind, they traverse a larger diameter. In this way, when the lock 32 is released, the centralizer 8 can be made to centralize the casing 10 in a larger diameter opening than the opening through which the centralizer 8 is free to pass when the spring blades 16 are rotatably compressed (as in FIG. 1).

Figure 3:
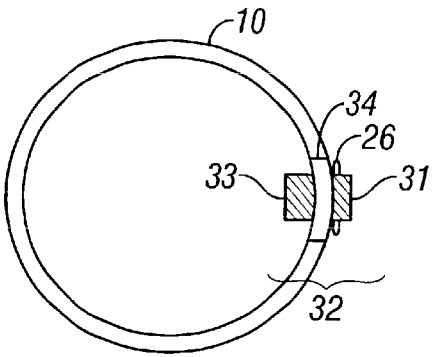
FIG. 3 shows one embodiment of a lock used to control expansion of the centralizer of FIG. 1.

One embodiment of the lock 32 is shown in more detail in FIG. 3. The lock 32 includes a first magnet 31 affixed to the control latch 26. The first magnet 31 moves in the slot 34. When the lock 32 is set to hold the centralizer in its compressed position (as in FIG. 1), a corresponding, second magnet 33 is positioned inside the casing 10 at the locked position of the first magnet 31. As will be appreciated by those skilled in the art, using magnets 31, 33 for the lock 32 requires that the casing be non-magnetic. Such types of casing are known in the art and can be made from monel, other material known in the art to be used for non-magnetic drill pipe and casing. As will be appreciated by those skilled in the art, the casing or instrument need only be non-magnetic in the vicinity of the magnets 31, 33. Devices such as short ("pup") sections of casing, or a non magnetic "patch" in the vicinity of the magnets can also be used with this embodiment of the invention.

Preferably the second magnet 33 is affixed to the interior of the casing 10 using adhesive of a type which enables the second magnet 33 to be released by application of a suitable shearing force. In this embodiment, to operate the lock 32, a sinker bar (not shown) or junk basket (not shown) of any type known in the art may be passed through the casing 10 to shear the second magnet 33 loose. When the second magnet 33 is removed, the first magnet 31 is not longer held in place by magnetic attraction from the second magnet 33, and is thus free to rotate. Preferably, the sinker bar or junk basket is of a type which can catch and retrieve the second magnet 33 when removed, so that a positive indication of its removal is obtained at the earth's surface and so that no excess debris is left inside the wellbore after operation of the centralizer (8 in FIG. 1). In selected applications of the invention, a plurality of centralizers according to this embodiment may be positioned at selected positions along the outside of a casing or instrument to be centralized in a wellbore. Each lock may be selectively operated, from shallowest to deepest, using the sinker bar or junk basket as previously described. Alternatively, a swab cup or similar device may be attached to a "work string" or wire cable and lowered into the wellbore below the deepest one of the centralizers. As the swab is retrieved from the wellbore, each lock can be selectively operated from deepest to shallowest, and all the magnets originally inside the casing 10 may thus be retrieved at the surface.

Although the releasable latch 25 is shown, for clarity of the illustration, as disposed axially outside the spring blades 16, other embodiments may have the latch 25 arranged so that it is substantially entirely with the axial span of the spring blades 16. Such an arrangement of the latch 25 provides protection therefor by the spring blades 16, so that the possibility of unintended actuation of the latch 25 while running the centralizer 8 through an opening is reduced.

Figure 6:
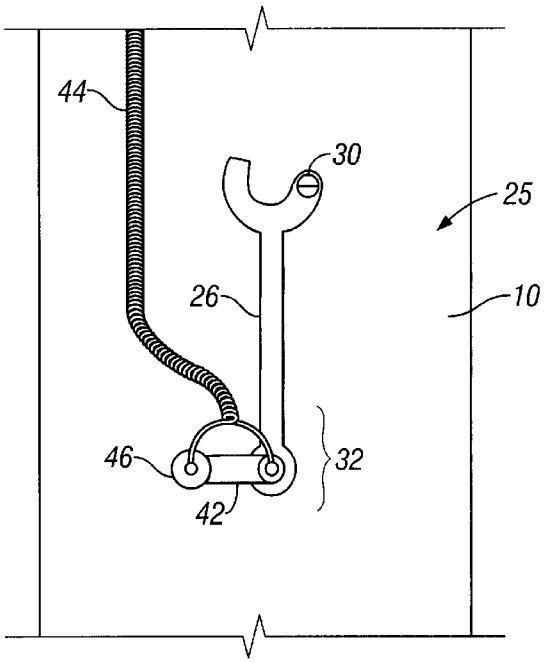
FIG. 6 shows an alternative embodiment of a lock used to release the centralizer.

Another embodiment of the lock 32 is shown in FIG. 6. In this embodiment, the lock 32 comprises a fusible link 42 which can be actuated by supplying electrical current along control wires 44. The fusible link 42 couples the end of the control latch 26 to an anchor pin 46 affixed to the outer surface of the casing 10. When the fusible link 42 is energized, it allows the free end of the control latch 26 to move, as in the previous embodiment, so that the second stop collar (20 in FIG. 1) is ultimately free to rotate. Other embodiments of the lock may include low temperature fusing metal in substitution of the fusible link 42, which would enable movement of the control latch 26 upon exposure of the low temperature metal link to sufficient heat in the wellbore.

Figure 8:
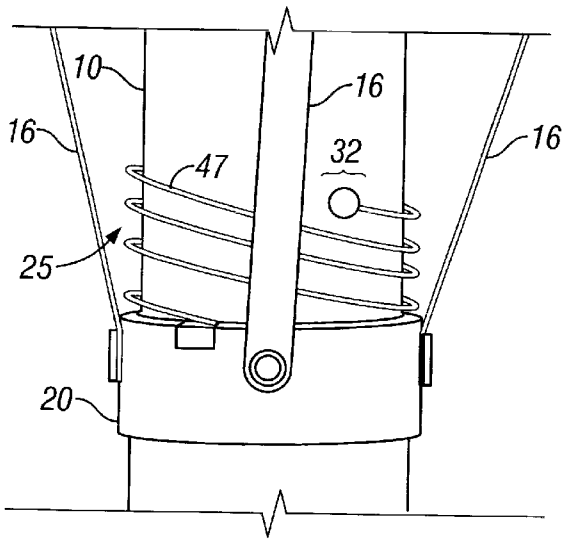
FIG. 8 shows another embodiment of a latch.

Another embodiment of the releasable latch 25 is shown in FIG. 8. In this embodiment, the latch 25 includes a latching band 47 which can be wrapped around the casing or instrument 10 a plurality of turns or wraps. The latching band 47 may be made from spring metal, flexible fiber reinforced plastic or other flexible material. One end of the band 47 is affixed to the second stop collar 20. The other end of the latching band 47 is coupled to the instrument or casing 10 by a lock 32 which can be of any type described herein, including magnets (as shown in FIG. 3), fusible link (as shown in FIG. 6) or similar device to enable the band 47 to be released from the casing 10. When the band 47 is released from the casing 10, the second stop collar 20 becomes free to rotate, enabling the spring blades 16 to expand as previously explained herein. The embodiment of the latch 25 shown in FIG. 8 is disposed entirely inside the axial span of the spring blades 16. As previously explained, this enables the spring blades 16 to protect the latch 25, reducing the possibility of unintended release thereof. It should be understood that this embodiment of the latch may also be disposed outside the axial span of the spring blades 16.

Figure 9:
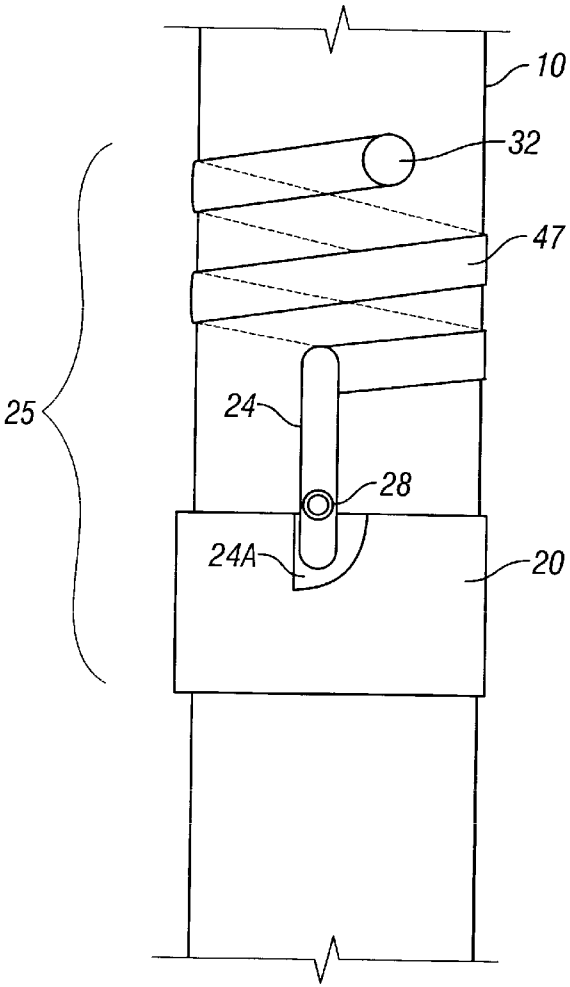
FIG. 9 shows another embodiment of a latch.

The latch 25 of FIG. 8 may be modified to reduce the restraining force needed to be applied by the band 47, as shown in another embodiment in FIG. 9. In the embodiment of FIG. 9, the band 47 is coupled at one end to a pivoting responding latch 24 that fits in a mating slot 24A on the second stop collar 20. The responding latch in the embodiment of FIG. 9 operates similarly to the responding latch of the embodiments shown in FIG. 1, the difference being that the responding latch 24 in FIG. 9 is released to enable rotation of the second stop collar 20 by selectably releasing the band 47 in any manner, including such as previously described.

Figure 4:
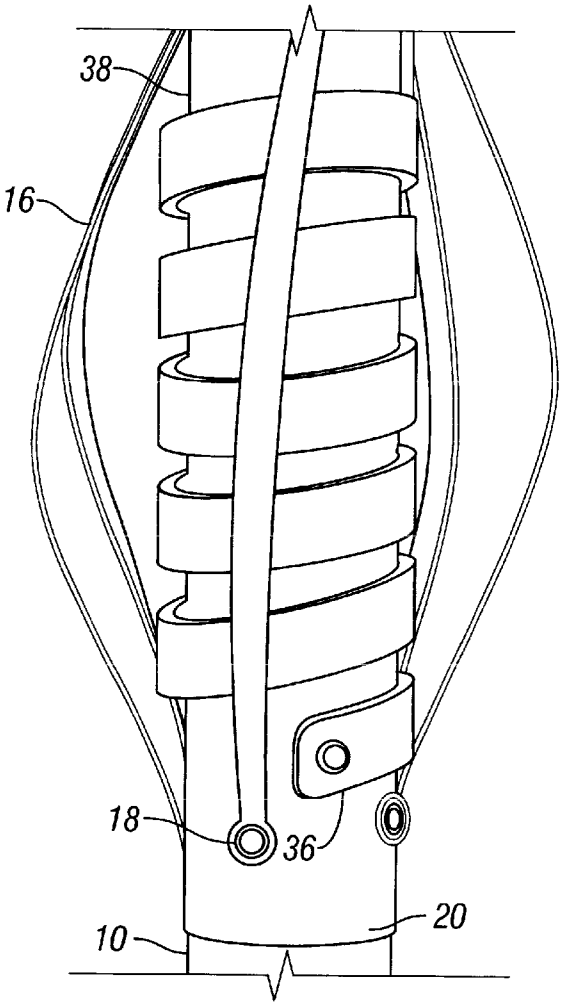
FIG. 4 shows another embodiment of a centralizer.

Another embodiment of the centralizer according to the invention is shown in FIG. 4. This embodiment is substantially similar in overall construction to the first embodiment, but includes a torsion spring 36 which is coupled at one end to the second stop collar 20, and is rotationally affixed to the casing 10 at its other end by a third stop collar 38 affixed to the casing, or alternatively may be affixed to the first stop collar (12 in FIG. 1). The torsion spring 36 is adapted to provide additional rotational restoring force when needed to assist the centralizer in moving particularly heavy casing, or when the wellbore is highly inclined from vertical or is horizontal.

Figure 5:
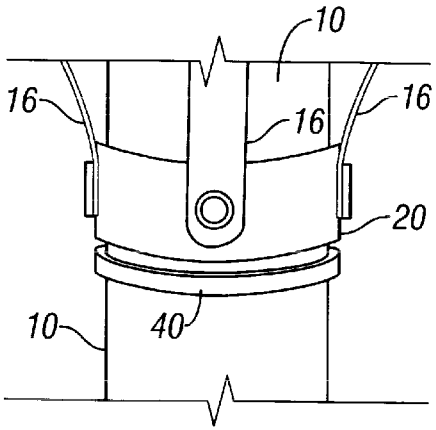
FIG. 5 shows an alternative form of axial restraint for a second stop collar on the centralizer.

An alternative embodiment of the centralizer includes an axial motion limiter for the second stop collar 20 as shown in FIG. 5. A limit ring 40, which can be made of brass, copper, aluminum or other soft metal, for example, can be heat shrunk, press fit, or otherwise affixed to the outside surface of the casing 10 in an axial position therealong similar to that of the pin (22 in FIG. 1). The stop ring 40 limits axial motion of the second stop collar 20 just as does the pin (22 in FIG. 1), but can be moved along the outside surface of the casing 10 by application of a selected amount of axial force to the second stop collar 20. The purpose of providing an axial motion restrain that can be overcome by application of the selected axial force is to provide the centralizer (8 in FIG. 1) with the capacity to be recovered through the smaller diameter opening after expansion of the centralizer in the larger diameter opening. A need for this capacity in some embodiments of the centralizer may arise, for example, if the wellbore operator finds that it is not possible to properly "land" the casing to which the centralizers are attached after expansion thereof. In such cases it would be necessary to pull the casing out of the wellbore through the smaller diameter opening (such as surface or intermediate casing). When the expanded centralizers are pulled through the smaller opening, the compressive force applied to the spring blades (16 in FIG. 1) will cause the second stop collar 20 to be forced against the limit ring 40. When the axial force exceeds the selected amount, the limit ring 40 will move, allowing the second stop collar 20 to move axially along the casing 10, so that the spring blades 16 can be compressed to traverse a smaller external diameter. In any embodiment, the diameter of the opening through which the compressed centralizer may pass is limited only to the outside diameter of the casing or instrument to which the centralizer is attached, plus the thickness of the spring blades.

Another embodiment of the centralizer may omit the limit ring (40 in FIG. 5) and the stop pin (22 in FIG. 1). The overall configuration of the centralizer according to this embodiment of the invention is similar to that of the previous embodiments, the difference being that the spring blades (16 in FIG. 1) are helically wound around the casing or instrument when the centralizer is in the fully unwound (torsionally relaxed) position. Casing centralizers having such relaxed configurations are known in the art, examples of which include those sold under model numbers "96R" and "56L" by Antelope Oil Tool & Manufacturing Company, Inc., Mineral Wells, Tex. Particularly where the spring blades 16 are oriented so as to be helically wound when torsionally relaxed, it has been determined that it is not necessary to include the limit ring or stop pin of the previous embodiments.

Figure 7:
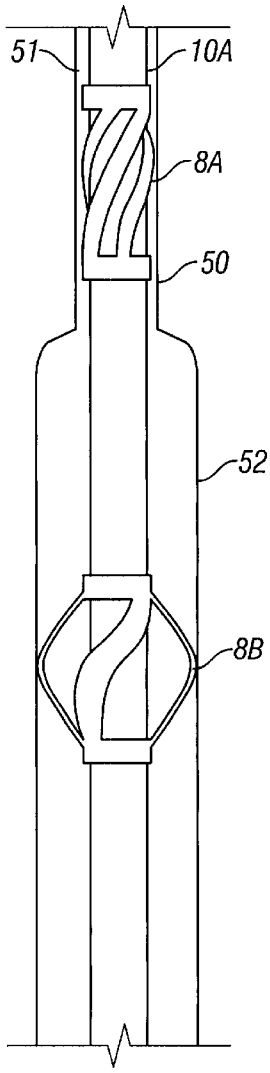
FIG. 7 shows examples of centralizers according to the invention, both expanded and compressed, run on a casing passing through an underreamed wellbore.

An example of using centralizers according to the various embodiments of the invention is shown in FIG. 7. A wellbore is drilled through earth formations using a drill bit of a diameter selected to enable running a casing string 50 therein. After the casing string 50 is cemented in place in the wellbore 51, the wellbore 51 can be drilled to a diameter larger than the diameter of the casing string 50 to produce an underreamed wellbore 52. As previously explained in the Background section herein, the underreamed wellbore 52 can be drilled using reaming tools, bi-center bits or similar devices which can pass through the inside of the casing string 50. An instrument 10A is then run through the casing string 50 into the underreamed wellbore 52. As previously explained, the instrument 10A can be a casing, a well logging tool, sand screen or any other tool or device which may require lateral positioning in the underreamed wellbore 52. Centralizers according to the various embodiments of the invention are attached at selected locations along the outside of the instrument 10A. A compressed centralizer is shown at 8A. After any centralizers are extended into the underreamed wellbore 52, they may be expanded, shown at 8B, and as previously explained, to help laterally position the instrument 10A in the underreamed wellbore 52.

The foregoing embodiments of an expandable centralizer are described in terms of being used with a casing. However, it should be clearly understood that the invention is not limited to use with casing, but may be used with other devices such as well logging instruments, gravel pack sand screens, or any other device or instrument the operation of which would be improved by having a centralizer which can expand to a diameter larger than the diameter of the opening through which it may freely pass.

While the invention has been described with respect to a limited number of embodiments, those skilled in the art will appreciate that other embodiments can be devised which do not depart from the scope of the invention as disclosed herein. Accordingly, the scope of the invention should be limited only by the attached claims.

What is claimed is:

1. A centralizer for laterally positioning an instrument in an opening larger in diameter than a diameter of an opening through which the centralizer can freely pass, comprising:

a first stop collar rotatably positioned proximate an outer surface of the instrument;

a plurality of spring blades extending substantially axially between the first stop collar and an axially spaced apart location along the instrument therefrom, the blades being axially and azimuthally fixed with respect to the instrument at the axially spaced apart location; and a latch operatively coupled between the first stop collar and the outer surface of the instrument, the latch adapted to enable azimuthal rotation of the first stop collar about the instrument upon release of the latch.

2. The centralizer as defined in claim 1 wherein the latch is disposed axially between ends of the spring blades.

3. The centralizer as defined in claim 1 wherein the latch comprises:

a control latch pivotally coupled at one end to the outer surface of the instrument and releasably locked to the outer surface of the instrument at another end; and a responding latch pivotally coupled to the outside surface of the instrument, the responding latch operatively engaged with the control latch at one end and operatively engaged to the first stop collar at the other end, the control and responding latches having pivot positions selected so that a force applied by locking the control latch is substantially less than a force applied by the first stop collar to the responding latch.

4. The centralizer as defined in claim 3 wherein the control latch is locked to the instrument by a first magnet disposed in the locked end of the control latch, and a second magnet disposed inside the surface of the instrument proximate a position of the first magnet.

5. The centralizer as defined in claim 3 wherein the control latch is locked to the instrument by an electrically actuated fusible link coupled to the locked end of the control latch and to the instrument.

6. The centralizer as defined in claim 3 wherein the control latch is locked to the instrument by a thermally actuated fusible link coupled to the locked end of the control latch and to the instrument.

7. The centralizer as defined in claim 1 further comprising an axial motion stop coupled to the exterior surface of the instrument proximate an axial position of the first stop collar, the axial motion stop adapted to be movable axially along the exterior surface of the instrument upon application of axial force to the axial motion stop exceeding a preselected threshold.

8. The centralizer as defined in claim 7 wherein the axial motion stop comprises a metal ring affixed to the exterior surface of the instrument.

9. The centralizer as defined in claim 1 further comprising a torsion spring operatively coupled between the outside surface of the instrument and the first stop collar.

10. The centralizer as defined in claim 1 wherein the spring blades are affixed to the instrument at the spaced apart location by a second stop collar affixed.

11. The centralizer as defined in claim 10 wherein the spring blades are each coupled at an end thereof to at least one of the first and second stop collars by a bearing.

12. The centralizer as defined in claim 1 wherein the spring blades are each coupled at an end thereof to at least one of the instrument and the first stop collar by a bearing.

13. The centralizer as defined in claim 1 wherein the latch comprises:

a band wound around the instrument and coupled at one end to the first stop collar, the band releasably coupled to the instrument at another end thereof.

14. The centralizer as defined in claim 13 wherein the one end of the band is locked to the instrument by a first magnet coupled thereto, and a second magnet disposed inside the surface of the instrument proximate a position of the first magnet.

15. The centralizer as defined in claim 13 wherein the one end of the band is locked to the instrument by an electrically actuated fusible link.

16. The centralizer as defined in claim 15 wherein the other end of the band is operatively linked to the stop collar through a responding latch, the responding latch adapted to reduce an amount of force needed to be applied to the stop collar to prevent rotation thereof when the responding latch is engaged.

* * * * *